US006182763B1

(12) United States Patent
Ingebrigtsen et al.

(10) Patent No.: US 6,182,763 B1
(45) Date of Patent: Feb. 6, 2001

(54) SUBSEA MODULE

(75) Inventors: Atle Ingebrigtsen, Nesttun; Jørgen Eide, Stend, both of (NO)

(73) Assignee: Den Norske Stats Oljeselskap A.S., Stavanger (NO)

( * ) Notice: Under 35 U.S.C. 154(b), the term of this patent shall be extended for 0 days.

(21) Appl. No.: 09/242,960

(22) PCT Filed: Aug. 21, 1997

(86) PCT No.: PCT/NO97/00219

§ 371 Date: Feb. 26, 1999

§ 102(e) Date: Feb. 26, 1999

(87) PCT Pub. No.: WO98/09051

PCT Pub. Date: Mar. 5, 1998

(30) Foreign Application Priority Data

Aug. 27, 1996 (NO) ..... 963586

(51) Int. Cl.[7] ..... E21B 43/013

(52) U.S. Cl. ..... 166/366; 166/352; 166/355; 166/345

(58) Field of Search ..... 166/366, 352, 166/355, 345, 347, 346

(56) References Cited

U.S. PATENT DOCUMENTS

| | | | | |
|---|---|---|---|---|
| 3,701,261 | * | 10/1972 | Nolan, Jr. | 166/352 X |
| 4,023,619 | * | 5/1977 | Marquaire et al. | 166/366 X |
| 4,211,281 | * | 7/1980 | Lawson | 166/366 X |
| 4,398,846 | * | 8/1983 | Agdern | 166/366 X |
| 4,625,806 | | 12/1986 | Silcox | 166/358 |
| 5,040,607 | * | 8/1991 | Cordeiro et al. | 166/366 X |
| 5,255,744 | * | 10/1993 | Silva | 166/347 |

FOREIGN PATENT DOCUMENTS

| | | |
|---|---|---|
| 2 656 274 | 12/1989 | (FR) . |
| 2 168 939 | 7/1986 | (GB) . |
| 8701005 | 10/1988 | (NO) . |
| 177780 | 8/1995 | (NO) . |
| 90/03492 | 4/1990 | (WO) . |

* cited by examiner

*Primary Examiner*—Eileen D. Lillis
*Assistant Examiner*—Sunil Singh
(74) *Attorney, Agent, or Firm*—Foley & Lardner

(57) ABSTRACT

Subsea unit for offshore production of oil or gas, comprising one or more wellheads with associated christmas trees provided on or at a bottom frame (template). On or at the template there is mounted a swivel device, having fluid connection to the christmas tree or trees and being provided with connection members for risers and an umbilical or control cable from a production vessel at the sea surface.

9 Claims, 2 Drawing Sheets

SUBSEA MODULE

FIELD OF INVENTION

The invention relates to a subsea module or station for offshore production of oil or gas, comprising at least two wellheads with associated christmas trees, and a manifold, whereby the christmas trees and the manifold are provided on or at a bottom frame (template). Such a module is intended for connection to a production vessel at the sea surface, by means of one or more risers, preferably flexible and hose-like risers.

BACKGROUND OF THE INVENTION

When developing marginal offshore production fields it is important to keep the costs low. A substantial cost factor with known forms of development, is due to subsea pipelines and cables between christmas trees at the wells and product receiver sites, for example a platform or a floating production vessel. Typically the distances involved may be about 2 km. In this connection it is to be noted that modern drilling technology makes it possible to produce by means of a reduced number of christmas trees, because the boreholes or wells can have several branches. This will make it possible to develop subsea fields in some instances by employing a small number of wellheads and christmas trees assembled on a common subsea module or station at the seabed.

International patent application PC/NO96/00201 dated Jul. 8, 1996 relates to a system for offshore production of hydrocarbons by employing a moored production vessel or ship. The present invention can be regarded as a further development thereof and is based on the idea that the production vessel can by lying directly above or in the immediate vicinity of the subsea module in production at the seabed and that the well fluid flows are transferred directly between the module and the vessel without relying on pipelines or cables on the seabed. In this connection the invention is not exclusively based upon location of the production vessel by means of mooring, as according to the international patent application mentioned above, but can also employ mean as known per se for dynamic positioning of the vessel.

BRIEF SUMMARY OF THE INVENTION

Thus, in a module as stated in the introduction above, the novel and specific features according to the invention in the first place comprise that on or at the template there is provided a swivel device having fluid connection to the manifold and being provided with connection members being preferably directed laterally, for risers and an umbilical from a production vessels at the sea surface.

On the basis of this fundamental solution, which in actual practice can be embodied in various forms, it is possible to obtain a number of advantages, of which in particular the following are mentioned:

- Reduced costs in that pipelines and cables on the seabed are avoided,
- the production vessel employed does not need any modifications worth mentioning, in relation to common ship designs, and therefore will be relatively inexpensive,
- the same production vessel can be used for installing and possibly retrieve the swivel device, or also for well maintenance, which contributes to reduced operational costs,
- very small marginal subsea fields can be profitable by using this novel arrangement, so that the degree of extraction can be increased for the fields,
- the equipment employed can be re-used by moving it from field to field.

A preferred embodiment of the present invention comprises a subsea module for offshore production of oil or gas, comprising a well template having a number of locations for christmas trees, at least one wellhead, at least one christmas tree mounted on the at least one wellhead, a swivel device provided in one christmas tree location, the swivel device having fluid connection to the at least one christmas tree and the swivel device being rotatable about a first, central vertical axis, at least one connecting member provided on the swivel device for connection with the at least one riser and with an umbilical or control cable from a production vessel at sea surface, a housing rotatable about the first central, vertical axis, at least one attachment member provided on the housing, a yoke connected to the at least one attachment member and pivotable about a horizontal axis at one end, the yoke adapted to be connected at its outer end to at least one mooring line of the production vessel.

In one aspect of the preferred embodiment, the housing is rotatably arranged on a base structure being carried by a supporting frame adapted for taking up mooring forces directly from the attachment elements without imposing any noticeable stresses on the swivel device.

In another aspect of the preferred embodiment, the yoke contains yoke limbs connected to attachment members and a lower end of the at least one riser is connected centrally to the swivel device and extends outwards from the swivel device centrally between the yoke limbs.

BRIEF DESCRIPTION OF THE DRAWINGS

In the following description the invention will be explained more closely with reference to the drawings, in which.

DETAILED DESCRIPTION OF THE INVENTION

Figure 1:
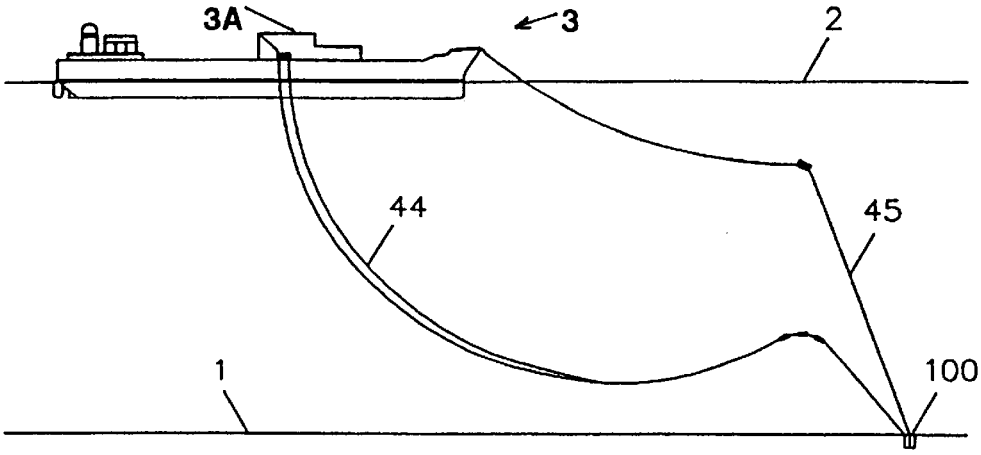
FIG. 1 shows a simplified overview of a total arrangement with a production vessel associated with a subsea module at the seabed.

In FIG. 1 there is shown a production vessel or ship 3 operating in association with a production or subsea module 100 at the seabed 1. Risers or hoses 44 are extended from module 100 to the ship 3 at the sea surface 2. On the ship 3 there is purely schematically shown a processing unit 3A. There is also shown an anchoring line 45 between unit 100 and mooring means at the bow portion of the ship 1. An intermediate region of anchoring line 45 is provided with a buoyancy element and likewise the riser or risers 44 have buoyancy bodies at a lower portion for elevating these risers from the seabed 1. This general arrangement is described more thoroughly in the International patent application mentioned above.

Figure 2:
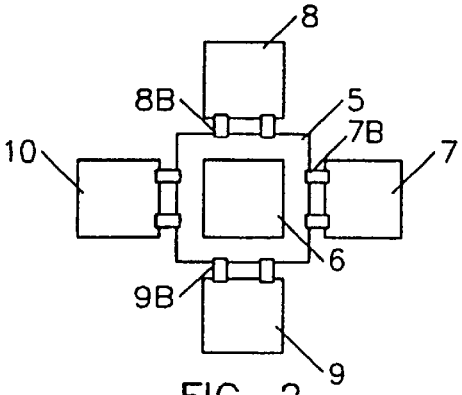
FIG. 2 shows an example of an arrangement of a subsea module according to the invention, as seen in plan view.
Figure 3:
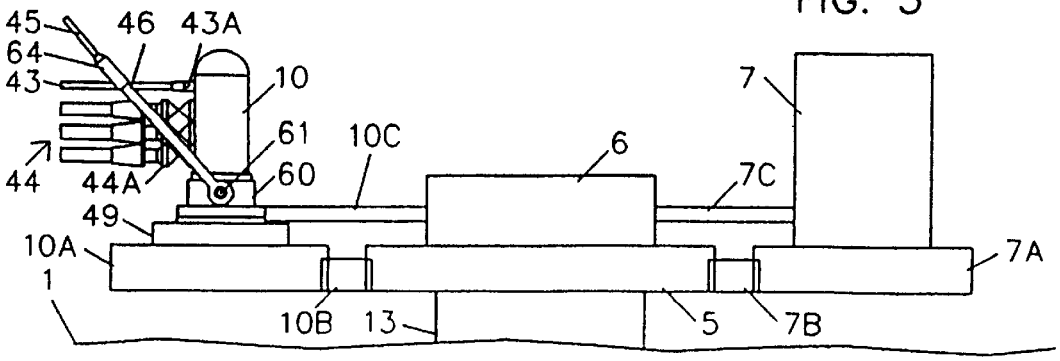
FIG. 3 shows the subsea module in FIG. 2 in enlarged elevation.

FIGS. 2 and 3 show a template 5 which by means of foundation structures 13 as known per se, is installed at the seabed 1. In this example template 5 is shown with a square basic shape, but it is obvious that the basic shape can have many variants. Centrally on template 5 there is shown a manifold 6 and at three sides of the template there are provided christmas trees 7,8 and 9. These are mechanically connected to or possibly supported by the template by means of beams 7B, 8B, 9B. Moreover, in FIG. 3 there is purely schematically shown a fluid connection 7C between christmas tree 7 and manifold 6. It is obvious that this connection can contain several separate fluid paths or pipes.

At one (left-hand) side of template 5 there is furthermore shown a swivel device 10 installed on a supporting frame 10A which in turn is mechanically connected to template 5 by means of beam elements 10B or the like. This supporting structure in the principle can correspond to the supporting frame 7A for christmas tree 7 and beams 7B. Instead of being completely supported or carried by the template 5, supporting frames 7A for the christmas trees and/or the supporting frame 10A for swivel device 10, can have a direct foundation on seabed 1 by means of methods known per se, such as piling.

Between swivel device 10 and manifold 6 there is shown a fluid connection 10C that like connection 7C can contain several fluid paths as well as conduits for electric and/or hydraulic control. The various fluid paths and control conduits comprised by connection 10C, are mainly passed through swivel device 10 to risers 44 and an umbilical 43 being extended upwards to the surface production vessel concerned, as generally illustrated in FIG. 1.

FIG. 3 also shows a yoke 46 to which the lower end of the vessel's mooring line or lines 45 are attached. Details regarding the yoke design and swivel device 10 will be explained more closely below with reference to FIGS. 6 and 7.

Figure 4:
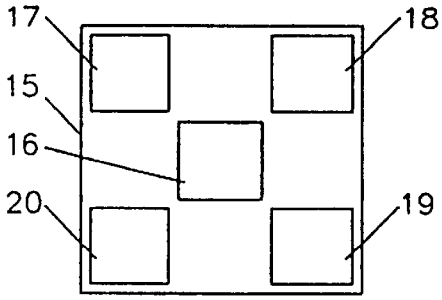
FIG. 4 shows a first alternative arrangement to the one shown in FIG. 2.
Figure 5:
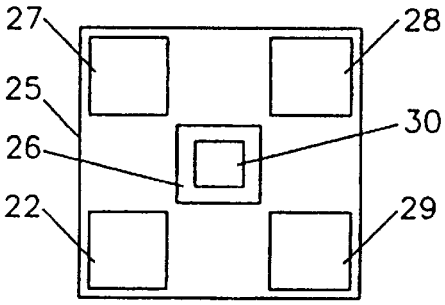
FIG. 5 shows a second alternative arrangement of a subsea module according to the invention, FIG. 6 in more detailed elevation and partial vertical section, shows an example of a convenient embodiment of a swivel device for subsea modules according to the invention.

In the alternative arrangements of FIGS. 4 and 5 there are shown relatively larger templates 15 and 25, respectively, than what is contemplated in FIG. 2. In both alternatives there is a manifold 16 and 26, respectively, located centrally on the template. Moreover, both alternatives are analogous in so far as both of them have four locations or positions for christmas trees, namely 22, 27, 28 and 29 in FIG. 5 and 17–19 in FIG. 4, whereby in this figure there is shown a swivel device 20 installed in a christmas tree position. Thus, in FIG. 4 the components 16, 17–19 and 20 shown are intended to be located individually and being each separately supported directly by the template or bottom frame 15.

Correspondingly in FIG. 5 manifold 26 and the four christmas trees 22, 27–29 are directly supported separately by template 26. In this embodiment however, swivel device 30 is mounted on manifold 26 and extends upwards therefrom. In certain conditions such a manifold can be superfluous, and in such case the swivel device 30 is located centrally on template 26 and is supported directly thereby.

Figure 7:
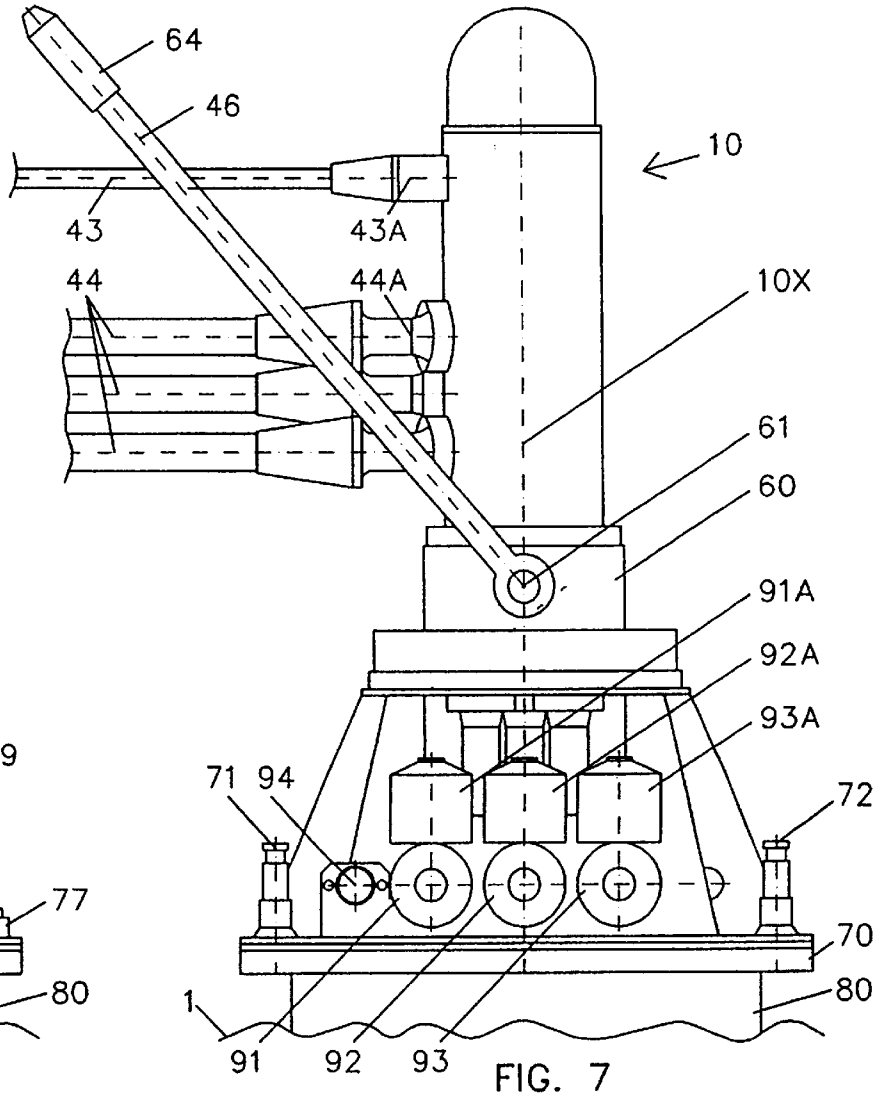
FIG. 7 shows the swivel device in FIG. 6 as seen from one side.
Figure 6:
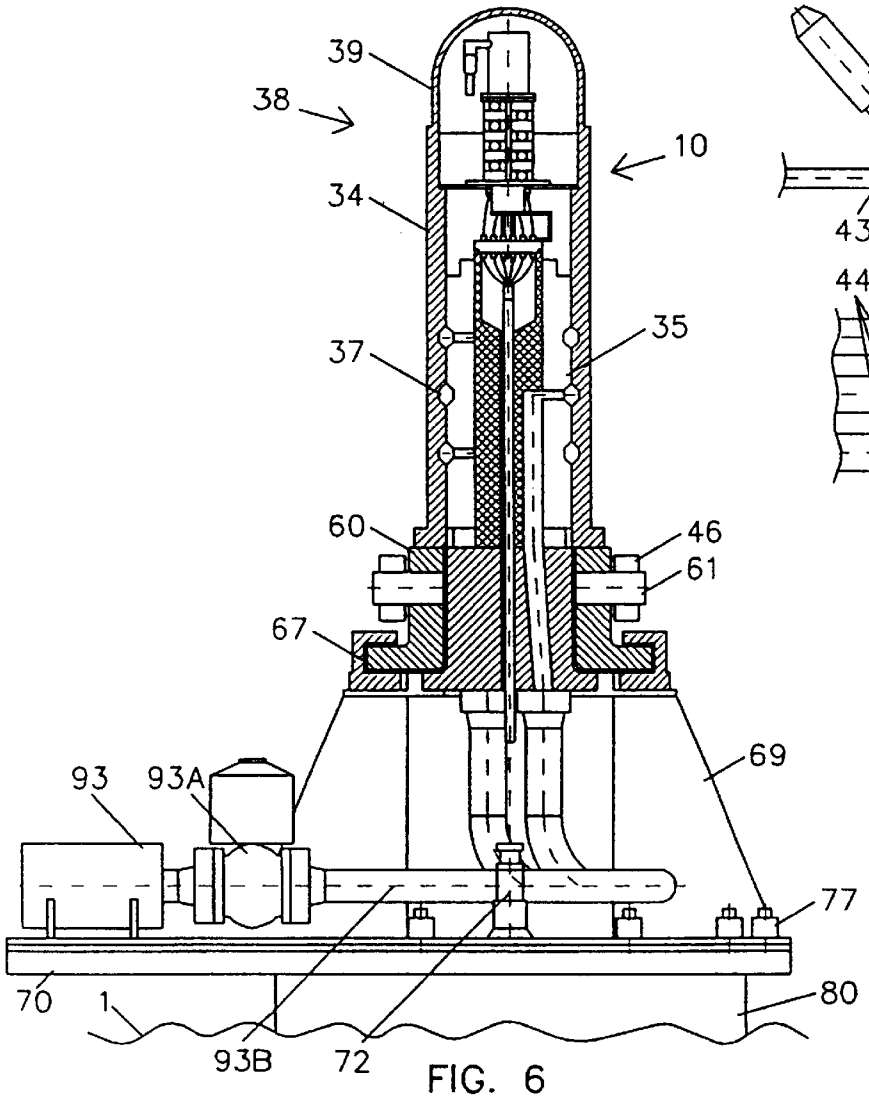

In the more detailed example of a swivel device 10 as shown in FIGS. 6 and 7, several of the elements in FIG. 3 are found again, but as far as the actual foundation is concerned, FIGS. 6 and 7 show a modification. A supporting frame 70, which corresponds substantially to the supporting frame 10A shown in FIG. 3, has its foundation directly on the seabed 1 by using a suction anchor 80 or a similar anchor device. This modified foundation as shown in FIGS. 6 and 7, doe snot exclude however, that swivel device 10 in these figures can be supported by the template 5, as shown in FIG. 3. The foundation according to FIGS. 6 and 7 imply, among other things, that mooring forces and other stresses to which the swivel device is subjected, will not impose any load on the template to which the swivel belongs.

Swivel device 10 has a stationary, central core member 35 with axially through-running bores which communicate downwards with fluid connections corresponding to connection 10C in FIG. 3. Around core member 35 there are provided two or more annular fluid passages with associated seals and bearing elements, as generally shown at 37. These elements of a fluid swivel are previously known per se, e.g. from Norwegian patent No. 177.780, which shows an axially seperable swivel device, primarily intended for other uses.

An outer swivel housing 34, adapted to rotate during turning movements of a moored production vessel, is bolted at the lower part to a rotatable housing or boss 60 being in its turn at 67 journalled as shown on a base structure or underframe 69. This can consist of a number of vertical plate parts the bottom of which is attached to the supporting frame 70.

As will be seen from FIG. 7, swivel 10 is provided with a connecting member 44A for each riser 44, which can suitably be in the form of flexible hoses. See in this connection the general arrangement of FIG. 1. Whereas connecting members 44A for fluid transfer are located relatively centrally on swivel 10 and directed laterally, an upper connecting member 43A for an umbilical 43 is located at an upper portion of swivel 10. A separate swivel part 38 at the level of connecting member 43A serves for required electrical and hydraulic communication for control purposes and the like, between the umbilical 43 and control or actuator means being commonly provided in subsea modules of the type in question here. A particular casing 39 on top of swivel housing 10, serves essentially for enclosing swivel part 38. For establishing connections corresponding to the connection 10C in FIG. 3, FIGS. 6 and 7 illustrate connectors 91, 92 and 93 as well as an electric/hydraulic connector 94 which through swivel 10 communicates with umbilical 43. In each of the three fluid connections there can be inserted an isolation valve 91A, 92A and 93A, respectively, among other things for the purpose of emergency closing. From connector 93 with associated isolation valve 93A there is shown in FIG. 6 a pipe connection 93B leading up to the bottom of swivel device 10. Corresponding connections are of course established also for the other connectors 91, 92 and 94.

In the load-carrying structure comprising supporting frame 70 and underframe 69, also bolt joints are incorporated as indicated at 77. Besides there are shown guide pins 71 and 72 for use when installing or retrieving the components above supporting frame 70, as in previously known techniques and methods in subsea installations.

The strong, carousel-like housing 60 together with swivel housing 34 and the rotatable inner devices therein, are rotatable about a central axis 10X as indicated in FIG. 7. Diametrically opposed attachment elements 61 in the form of projecting studs from housing 60, serve for pivotable attachment of the lower ends of yoke limbs 46, the upper end 64 of which is adapted to be connected to one or more mooring lines, as shown in FIG. 3. The two yoke limbs 46 are joined at the upper end 64, where there can be provided a cross member between the upper ends of the yoke limbs. Yoke 46 can assume various angular positions by pivoting about the horizontal axis running diametrically between attachment elements 61, whereby the angular range of the yoke movement extends upwards at least to an approximate vertical position, whereas in actual practice the lowest angular position is restricted in view of umbilical 43 and/or risers 44.

It is a practical advantage to arrange umbilical 43 and risers 44 so that they extend laterally from swivel 10 substantially centrally between the two yoke limbs 46. Moreover, it is preferred in this connection that risers 44 and possibly umbilical 43 during all operative conditions and changing vessel positions as well as mooring forces, extend out from swivel device 10 at a more horizontal angular position than the angular position of yoke 46. With the illustrated relative height positions of the attachment elements 61 for the yoke 46 at the one hand and connection members 44A for risers 44 as well as connection member 43A for umbilical on the other hand, the forces occurring during cooperation with a moored production vessel, will be taken up in the structure in a favourable manner. In the practical arrangement on or at a template the swivel device with its associated lines, cables and pipes or hoses, should be so located in relation to the remaining components on the template, that there is no conflict with lines, cables or risers/hoses as mentioned.

What is claimed is:

1. A subsea module for offshore production of oil or gas, comprising:

a well template having a number of locations for christmas trees;

at least one wellhead;

at least one christmas tree mounted on the at least one wellhead;

a swivel device provided in one christmas tree location, the swivel device having fluid connection to the at least one christmas tree and the swivel device being rotatable about a first, central vertical axis;

at least one connecting member provided on the swivel device for connection with at least one riser and another connecting member provided on the swivel device for connection with an umbilical or control cable from a production vessel at sea surface;

a housing rotatable about the first central, vertical axis;

at least one attachment member provided on the housing;

a yoke connected to the at least one attachment member and pivotable about a horizontal axis at one end, the yoke adapted to be connected at its other end to at least one mooring line of the production vessel.

2. The subsea module according to claim 1, further comprising a manifold located centrally on the well template and wherein the swivel device is supported by the manifold.

3. The subsea module according to claim 1, wherein the swivel device is located centrally on the template.

4. The subsea module according to claim 1, wherein the housing is rotatably arranged on a base structure being carried by a supporting frame adapted for taking up mooring forces directly from the at least one attachment member without imposing any noticeable stresses on the swivel device.

5. The subsea module according to claim 1, wherein the housing is rotatably arranged on a base structure being carried by a supporting frame;

and wherein the supporting frame contains an independent foundation on a seabed comprising a suction anchor, for transferring mooring forces directly from the at least one attachment member to the suction anchor without imposing any noticeable stresses on the swivel device or the template.

6. The subsea module according to claim 1, further comprising a mechanical coupling between the swivel device and the housing for common rotation of said swivel device and said housing.

7. The subsea module according to claim 1, wherein the yoke contains two yoke limbs connected to two attachment members; and a lower end of the at least one riser is connected centrally to the swivel device and extends outwards from the swivel device centrally between the two yoke limbs.

8. The subsea module according to claim 7, wherein plural risers extend from said swivel device at a more horizontal angular position than the angular position of the yoke limbs during substantially all mooring conditions.

9. The subsea module according to claim 7, wherein the connecting member for the umbilical cable is located at an upper part of said swivel device, and wherein the swivel device contains a swivel part for conduit connections at the same level as the connecting member for the umbilical cable.

* * * * *